US005674376A

United States Patent [19]

Heyse et al.

[11] Patent Number: 5,674,376

[45] Date of Patent: *Oct. 7, 1997

[54] LOW SUFUR REFORMING PROCESS

[75] Inventors: John V. Heyse, Crockett; Bernard F. Mulaskey, Fairfax; Robert L. Hise, Richmond; Steven E. Trumbull, San Leandro, all of Calif.

[73] Assignee: Chevron Chemical Company, San Ramon, Calif.

[ * ] Notice: The term of this patent shall not extend beyond the expiration date of Pat. No. 5,405,525.

[21] Appl. No.: 473,329

[22] Filed: Jun. 7, 1995

Related U.S. Application Data

[60] Division of Ser. No. 177,125, Jan. 4, 1994, abandoned, which is a continuation-in-part of Ser. No. 803,063, Dec. 6, 1991, abandoned, and a continuation-in-part of Ser. No. 802,821, Dec. 6, 1991, abandoned, and a continuation-in-part of Ser. No. 803,215, Dec. 6, 1991, abandoned, which is a continuation-in-part of Ser. No. 666,696, Mar. 8, 1991, abandoned.

[51] Int. Cl.[6] ..... C10G 35/04

[52] U.S. Cl. ..... 208/135; 208/137; 208/48 R; 208/47; 585/407

[58] Field of Search ..... 106/1.12, 1.13, 106/1.18, 1.25, 1.26, 15.05, 1.05, 1.22, 459; 208/135, 137, 48 R, 48 AA, 47; 585/407

[56] References Cited

U.S. PATENT DOCUMENTS

| | | |
|---|---|---|
| 1,883,630 | 10/1932 | Duff . |
| 2,063,596 | 12/1936 | Feiler . |
| 2,263,366 | 11/1941 | Peck et al. . |
| 2,818,374 | 12/1957 | Certa et al. . |
| 2,929,775 | 3/1960 | Aristoff et al. . |
| 3,160,671 | 12/1964 | Feigelman . |
| 3,169,000 | 2/1965 | Earnst et al. . |
| 3,178,321 | 4/1965 | Satterfield . |
| 3,284,526 | 11/1966 | Frayer . |
| 3,459,821 | 8/1969 | Engelbrecht . |
| 3,531,394 | 9/1970 | Kuszman . |
| 3,531,543 | 9/1970 | Clippinger et al. . |
| 3,536,776 | 10/1970 | Lo . |
| 3,584,060 | 6/1971 | Rausch . |
| 3,607,960 | 9/1971 | Button . |
| 3,631,215 | 12/1971 | Clippinger et al. . |
| 3,686,340 | 8/1972 | Patrick et al. . |
| 3,700,745 | 10/1972 | Kovach et al. . |
| 3,835,183 | 9/1974 | Carpenter et al. . |
| 3,864,284 | 2/1975 | Clippinger et al. . |
| 3,878,131 | 4/1975 | Hayes . |
| 3,890,686 | 6/1975 | Caubet . |
| 3,966,833 | 6/1976 | Cosyns et al. . |
| 4,013,487 | 3/1977 | Ramqvist et al. . |
| 4,015,950 | 4/1977 | Galland et al. . |
| 4,019,969 | 4/1977 | Golebiowski et al. . |
| 4,058,452 | 11/1977 | Loboda . |
| 4,111,763 | 9/1978 | Pryor . |

(List continued on next page.)

FOREIGN PATENT DOCUMENTS

| | | |
|---|---|---|
| 0 082 920 | 7/1983 | European Pat. Off. . |
| 0 146 081 | 6/1985 | European Pat. Off. . |

(List continued on next page.)

OTHER PUBLICATIONS

"Report of the Panel on High Temperature Carburization to the Subcommittee on Corrosion", May 1963 (unclear whether a publication).

robert Schueler, Hydrocarbon Processing, Aug. 1972.

(List continued on next page.)

*Primary Examiner*—Glenn A. Caldarola
*Assistant Examiner*—Bekir L. Yildirim
*Attorney, Agent, or Firm*—Burns, Doane, Swecker & Mathis, LLP

[57] ABSTRACT

Disclosed is a method for reforming hydrocarbons comprising contacting the hydrocarbons with a catalyst in a reactor system of improved resistance to carburization and metal dusting under conditions of low sulfur.

18 Claims, 2 Drawing Sheets

U.S. PATENT DOCUMENTS

| | | | |
|---|---|---|---|
| 4,132,743 | 1/1979 | Caster et al. . | |
| 4,161,510 | 7/1979 | Edridge . | |
| 4,163,706 | 8/1979 | Horowitz et al. . | |
| 4,167,532 | 9/1979 | Walker et al. . | |
| 4,167,533 | 9/1979 | Raymond . | |
| 4,179,361 | 12/1979 | Michlmayr . | |
| 4,189,613 | 2/1980 | Bjornson . | |
| 4,191,632 | 3/1980 | Cosyns et al. . | |
| 4,191,846 | 3/1980 | Farha, Jr. et al. . | |
| 4,204,997 | 5/1980 | Hobbs et al. . | |
| 4,208,302 | 6/1980 | McKay . | |
| 4,215,231 | 7/1980 | Raymond . | |
| 4,264,433 | 4/1981 | McKay . | |
| 4,268,188 | 5/1981 | Bertus . | |
| 4,271,008 | 6/1981 | Vogt et al. . | |
| 4,297,150 | 10/1981 | Foster et al. . | |
| 4,385,645 | 5/1983 | Campbell . | |
| 4,404,087 | 9/1983 | Reed . | |
| 4,410,418 | 10/1983 | Kukes et al. . | |
| 4,438,288 | 3/1984 | Imai . | |
| 4,447,316 | 5/1984 | Buss et al. . | |
| 4,451,687 | 5/1984 | Daly et al. . | |
| 4,456,527 | 6/1984 | Buss et al. . | |
| 4,463,206 | 7/1984 | Derrien et al. . | |
| 4,467,016 | 8/1984 | Baldi . | |
| 4,471,151 | 9/1984 | Kolts . | |
| 4,488,578 | 12/1984 | Tseung et al. . | |
| 4,507,196 | 3/1985 | Reed . | |
| 4,511,405 | 4/1985 | Reed . | |
| 4,545,893 | 10/1985 | Porter . | |
| 4,551,227 | 11/1985 | Porter . | |
| 4,552,643 | 11/1985 | Porter . | |
| 4,595,673 | 6/1986 | Imai et al. . | |
| 4,613,372 | 9/1986 | Porter . | |
| 4,665,267 | 5/1987 | Barri . | |
| 4,666,583 | 5/1987 | Porter . | |
| 4,686,201 | 8/1987 | Porter . | |
| 4,687,567 | 8/1987 | Porter . | |
| 4,692,234 | 9/1987 | Porter et al. . | |
| 4,716,143 | 12/1987 | Imai . | |
| 4,727,216 | 2/1988 | Miller . | |
| 4,741,819 | 5/1988 | Robinson et al. . | |
| 4,743,318 | 5/1988 | Fischer et al. . | |
| 4,786,625 | 11/1988 | Imai et al. . | |
| 4,795,732 | 7/1989 | Barri . | |
| 4,804,487 | 2/1989 | Reed . | |
| 4,827,072 | 5/1989 | Imai et al. . | |
| 4,863,892 | 9/1989 | Porter . | |
| 4,902,849 | 2/1990 | McKay et al. . | |
| 4,917,969 | 4/1990 | Pircher . | |
| 4,925,549 | 5/1990 | Robinson et al. . | |
| 4,926,005 | 5/1990 | Olbrich et al. . | |
| 4,935,566 | 6/1990 | Dessau et al. . | |
| 4,982,047 | 1/1991 | Barri et al. . | |
| 5,012,027 | 4/1991 | Abrevaya et al. . | |
| 5,015,358 | 5/1991 | Reed . | |
| 5,053,574 | 10/1991 | Tsutsui et al. . | |
| 5,139,814 | 8/1992 | Sugaro . | |
| 5,139,914 | 8/1992 | Tomiyama et al. . | |
| 5,405,525 | 4/1995 | Heyse et al. | 208/133 |

FOREIGN PATENT DOCUMENTS

| | | |
|---|---|---|
| 0192 059 | 8/1986 | European Pat. Off. . |
| 0351 067 | 1/1990 | European Pat. Off. . |
| 403 976 | 12/1990 | European Pat. Off. . |
| 1521848 | 4/1969 | Germany . |
| 313303 | 8/1929 | United Kingdom . |
| 317303 | 8/1929 | United Kingdom . |
| 1054121 | 1/1967 | United Kingdom . |
| 1122017 | 7/1968 | United Kingdom . |
| 1149163 | 4/1969 | United Kingdom . |
| 1604604 | 12/1981 | United Kingdom . |
| 2162082 | 1/1986 | United Kingdom . |
| 2234530 | 2/1991 | United Kingdom . |
| WO92/15653 | 9/1992 | WIPO . |
| WO94/15896 | 7/1994 | WIPO . |

OTHER PUBLICATIONS

R. Hochman and J. Burson III, Proceedings Division of Refining, "The Fundamentals of Metal Dusting", vol. 46 (1966).

G. L. Swales, "High Temperature Corrosion Problems in the Petroleum Refining and Petrochemical Industries", pp. 45–82.

R.F. Hochman, "Catastrophic Deterioration of High Temperature Alloys in Carbonaceous Atmospheres", pp. 715–732, Proceedings Of The Symposium On Properties Of High Temperature Alloys, 1978.

Hettinger, Keith, Gring and Ieter, Industrial And Engineering Chemistry, "Hydroforming Reactions, Effect of Certain Catalyst Properties and Poisons", Apr. 1955.

F. A. Prange, Corrosion, "Corrosion in a Hydrocarbon Conversion System", vol. 15, Dec. 1959.

C.J. Polk, "Evaluating Catalytic Reformer Heater Tubing After Extended High–Temperature Service", Nat'l. Assoc of Corros. Engineers, Paper No. 50, Mar. 1980.

Excerpts from NPRA (National Petroleum Refiners Assoc.), Q&A, 1981 (Questions 17 & 21).

Excerpts from 1980 PEP Report, "Reforming for BTX". SRI International.

R.G. McClung, Oil & Gas Journal, pp. 98 & 99 (Oct. 1990).

D.M. Little, Catalytic Reforming, pp. 136–141.

Excerpts from NPRA, Q&A, 1982 (Question 21).

Buss et al, "New Developments in Rheniforming", 1978 NPRA Annual Meeting (1978).

Freiburger et al, "Recent Catalyst and Process Improvements in Commercial Rheniforming", 1980 NPRA Annual Meeting (1980).

Shinohara, Kohchi, Shibata, Sugitani and Tsuchida; "Development of nondestructive technique for measuring carburization thickness and a new carburization–resistant alloy"; Werkstoffe Und Korrosion, 1986; pp. 410–411. (no month).

Alon Processing, Inc.; "Alonized Steels for high temperature corrosion resistance"; 1990; pp. 1–19. (no month).

Micron, Inc., Analytical Service Laboratory; "Report #R–8126, Alonized Steel"; Jun. 1985.

W. A. McGill and M. J. Weinbaum, "The Selection, Application and Fabrication of Alonized Systems in the Refinery Environment"; 1975; pp. 1–18 (no month).

Pujado et al., "Make $C_3$–$C_4$ Olefins Selectively"; Hydrocarbon Processing; pp. 65–70; Mar. 1990.

Dunn, "HP In Construction"; Hydrocarbon Processing; pp. 41–42; Aug. 1991.

Pujado et al., "Production of LPG Olefins by Catalytic Dehydrogenation"; Energy Progress; vol. 4, No. 3; pp. 186–191; Sep. 1984.

Pujado et al., "OGJ Report"; Oil and Gas Journal; pp. 71–74; Mar. 1983.

Berg et al., "Catalytic LPG Dehydrogenation Fits in '80's Outlook"; Oil and Gas Journal; pp. 191–197; Nov. 1980.

Gussow et al., "Dehydrogenation Links LPG to More Octanges"; Oil and Gas Journal; pp. 96–101; Dec. 1980.

Tokyo Engineering Corp. and Kubota; "Coret, New Cracking Tube to Retard Coke Depositions"; Mar. 1986; pp. 1–5.

Tokyo Engineering Corp. and Kubota: "Development of Double–Layer Cast Tube for Anti–Carburization and the Retarding of Coke Deposition"; pp. 1–11 (No Date).
King et al., "The Production of Ethylene by the Decomposition of n–Butane; the Prevention of Carbon Formation by the Use of Chromium plating".
Platt's International Petrochemical Report (Oct. 1993).
J. R. Bernard, "Hydrocarbons Aromatization on Platinum Alkaline Zeolites", Proceedings of the Fifth Int. Conf. Zeolites, pp. 686–695, Heydon, London (1980). (no month).

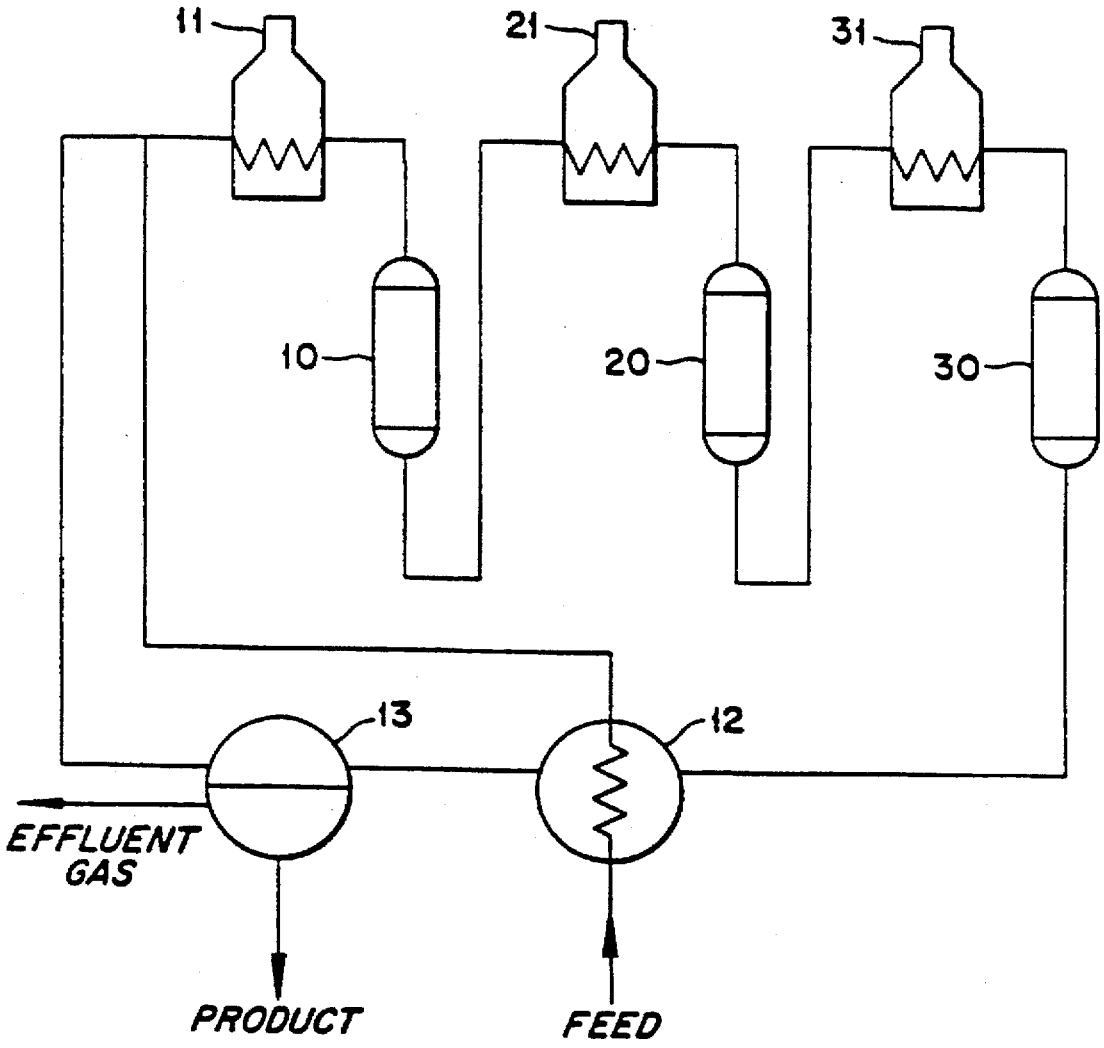
11
21
31
10
20
30
13
12
EFFLUENT GAS
PRODUCT
FEED

LOW SUFUR REFORMING PROCESS

This application is a divisional of U.S. application Ser. No. 08/177,125, filed Jan. 4, 1994, which was a continuation-in-part application of U.S. application Ser. No. 07/803,063, U.S. application Ser. No. 07/802,821, and U.S. application Ser. No. 07/803,215, all filed on Dec. 6, 1991, the contents of which applications are hereby incorporated by reference; all which were continuation-in-part applications of U.S. application Ser. No. 07/666,696, filed Mar. 8, 1991, the contents of which is hereby incorporated by reference all now abandoned.

BACKGROUND OF THE INVENTION

The present invention relates to improved techniques for catalytic reforming, particularly, catalytic reforming under low-sulfur, and low-sulfur and low-water conditions. More specifically, the invention relates to the discovery and control of problems particularly acute with low-sulfur, and low-sulfur and low-water reforming processes.

Catalytic reforming is well known in the petroleum industry and involves the treatment of naphtha fractions to improve octane rating by the production of aromatics. The more important hydrocarbon reactions which occur during the reforming operation include the dehydrogenation of cyclohexanes to aromatics, dehydroisomerization of alkylcyclopentanes to aromatics, and dehydrocyclization of acyclic hydrocarbons to aromatics. A number of other reactions also occur, including the dealkylation of alkylbenzenes, isomerization of paraffins, and hydrocracking reactions which produce light gaseous hydrocarbons, e.g., methane, ethane, propane and butane. It is important to minimize hydrocracking reactions during reforming as they decrease the yield of gasoline boiling products and hydrogen.

Because there is a demand for high octane gasoline, extensive research has been devoted to the development of improved reforming catalysts and catalytic reforming processes. Catalysts for successful reforming processes must possess good selectivity. That is, they should be effective for producing high yields of liquid products in the gasoline boiling range containing large concentrations of high octane number aromatic hydrocarbons. Likewise, there should be a low yield of light gaseous hydrocarbons. The catalysts should possess good activity to minimize excessively high temperatures for producing a certain quality of products. It is also necessary for the catalysts to either possess good stability in order that the activity and selectivity characteristics can be retained during prolonged periods of operation; or be sufficiently regenerable to allow frequent regeneration without loss of performance.

Catalytic reforming is also an important process for the chemical industry. There is an increasingly larger demand for aromatic hydrocarbons for use in the manufacture of various chemical products such as synthetic fibers, insecticides, adhesives, detergents, plastics, synthetic rubbers, pharmaceutical products, high octane gasoline, perfumes, drying oils, ion-exchange resins, and various other products well known to those skilled in the art.

An important technological advance in catalytic reforming has recently emerged which involves the use of large-pore zeolite catalysts. These catalysts are further characterized by the presence of an alkali or alkaline earth metal and are charged with one or more Group VIII metals. This type of catalyst has been found to advantageously provide higher selectivity and longer catalytic life than those previously used.

Having discovered selective catalysts with acceptable cycle lives, successful commercialization seemed inevitable. Unfortunately, it was subsequently discovered that the highly selective, large pore zeolite catalysts containing a Group VIII metal were unusually susceptible to sulfur poisoning. See U.S. Pat. No. 4,456,527. Ultimately, it was found that to effectively address this problem, sulfur in the hydrocarbon feed should be at ultra-low levels, preferably less than 100 pans per billion (ppb), more preferably less than 50 ppb to achieve an acceptable stability and activity level for the catalysts.

After recognizing the sulfur sensitivity associated with these new catalysts and determining the necessary and acceptable levels of process sulfur, successful commercialization reappeared on the horizon; only to vanish with the emergence of another associated problem. It was found that certain large pore zeolite catalysts are also adversely sensitive to the presence of water under typical reaction conditions. Particularly, water was found to greatly accelerate the rate of catalyst deactivation.

Water sensitivity was found to be a serious drawback which was difficult to effectively address. Water is produced at the beginning of each process cycle when the catalyst is reduced with hydrogen. And, water can be produced during process upsets when water leaks into the reformer feed, or when the feed becomes contaminated with an oxygen-containing compound. Eventually, technologies were also developed to protect the catalysts from water.

Again commercialization seemed practical with the development of various low-sulfur, low-water systems for catalytic reforming using highly selective large-pore zeolite catalysts with long catalytic lives. While low-sulfur/low-water systems were initially effective, it was discovered that a shut down of the reactor system can be necessary after only a matter of weeks. The reactor system of one test plant had regularly become plugged after only such brief operating periods. The plugs were found to be those associated with coking. However, although coking within catalyst particles is a common problem in hydrocarbon processing, the extent and rate of coke plug formation exterior to the catalyst particles associated with this particular system far exceeded any expectation.

SUMMARY OF THE INVENTION

Accordingly, one object of the invention is to provide a method for reforming hydrocarbons under conditions of low sulfur which avoids the aforementioned problems found to be associated with low-sulfur processes, such as brief operating periods.

It is another object of the invention to provide a reactor system for reforming hydrocarbons under conditions of low sulfur which permits longer operating periods.

After a detailed analysis and investigation of the coke plugs of low-sulfur reactor systems, it was surprisingly found that they contained particles and droplets of metal; the droplets ranging in size of up to a few microns. This observation led to the startling realization that there are new, profoundly serious, problems which were not of concern with conventional reforming techniques where process sulfur and water levels were significantly higher. More particularly, it was discovered that problems existed which threatened the effective and economic operability of the systems, and the physical integrity of the equipment as well. It was also discovered that these problems emerged due to the low-sulfur conditions, and to some extent, the low levels of water.

For the last forty years, catalytic reforming reactor systems have been constructed of ordinary mild steel (e.g., 2¼ Cr 1 Mo). Over time, experience has shown that the systems can operate successfully for about twenty years without significant loss of physical strength. However, the discovery of the metal particles and droplets in the coke plugs eventually lead to an investigation of the physical characteristics of the reactor system. Quite surprisingly, conditions were discovered which are symptomatic of a potentially severe physical degradation of the entire reactor system, including the furnace tubes, piping, reactor walls and other environments such as catalysts that contain iron and metal screens in the reactors. Ultimately, it was discovered that this problem is associated with the excessive carburization of the steel which causes an embrittlement of the steel due to injection of process carbon into the metal. Conceivably, a catastrophic physical failure of the reactor system could result.

With conventional reforming techniques carburization simply was not a problem or concern; nor was it expected to be in contemporary low-sulfur/low-water systems. And, it was assumed that conventional process equipment could be used. Apparently, however, the sulfur present in conventional systems effectively inhibits carburization. Somehow in conventional processes the process sulfur interferes with the carburization reaction. But with extremely low-sulfur systems, this inherent protection no longer exists.

FIG. 1A is a photomicrograph of a portion of the inside (process side) of a mild steel furnace tube from a commercial reformer. The tube had been exposed to conventional reforming conditions for about 19 years. This photograph shows that the surface of the tube has remained essentially unaltered with the texture of the tube remaining normal after long exposure to hydrocarbons at high temperatures (the black portion of the photograph is background).

FIG. 1B is a photomicrograph of a portion of a mild steel coupon sample which was placed inside a reactor of a low-sulfur/low-water demonstration plant for only 13 weeks. The photograph shows the eroded surface of the sample (contrasted against a black background) from which metal dusting has occurred. The dark grey-like veins indicate the environmental carburization of the steel, which was carburized and embrittled more than 1 mm in depth.

Of course, the problems associated with carburization only begin with carburization of the physical system. The carburization of the steel walls leads to "metal dusting"; a release of catalytically active particles and melt droplets of metal due to erosion of the metal.

The active metal particulates provide additional sites for coke formation in the system. While catalyst deactivation from coking is generally a problem which must be addressed in reforming, this new significant source of coke formation leads to a new problem of coke plugs which excessively aggravates the problem. In fact, it was found that the mobile active metal particulates and coke particles metastasize coking generally throughout the system. The active metal particulates actually induce coke formation on themselves and anywhere that the particles accumulate in the system resulting in coke plugs and hot regions of exothermic demethanation reactions. As a result, an unmanageable and premature coke-plugging of the reactor system occurs which can lead to a system shut-down within weeks of start-up. Use of the process and reactor system of the present invention, however, overcomes these problems.

Therefore, a first aspect of the invention relates to a method for reforming hydrocarbons comprising contacting the hydrocarbons with a reforming catalyst, preferably a large-pore zeolite catalyst including an alkali or alkaline earth metal and charged with one or more Group VIII metals, in a reactor system having a resistance to carburization and metal dusting which is an improvement over conventional mild steel reactor systems under conditions of low sulfur and often low sulfur and low water, and upon reforming the resistance being such that embrittlement from carburization will be less than about 2.5 mm/year, preferably less than 1.5 mm/year, more preferably less than 1 mm/year, and most preferably less than 0.1 mm/year. Preventing embrittlement to such an extent will significantly reduce metal dusting and coking in the reactor system, and permits operation for longer periods of time.

And, another aspect of the invention relates to a reactor system including means for providing a resistance to carburization and metal dusting which is an improvement over conventional mild steel systems in a method for reforming hydrocarbons using a reforming catalyst such as a large-pore zeolite catalyst including an alkaline earth metal and charged with one or more Group VIII metals under conditions of low sulfur, the resistance being such that embrittlement will be less than about 2.5 mm/year, preferably less than 1.5 mm/year, more preferably less than 1 mm/year, and most preferably less than 0.1 mm/year.

Thus, among other factors, the present invention is based on the discovery that in low-sulfur, and low-sulfur and low-water reforming processes there exist significant carburization, metal dusting and coking problems, which problems do not exist to any significant extent in conventional reforming processes where higher levels of sulfur are present. This discovery has led to intensive work and development of solutions to the problems which solutions are novel to low-sulfur reforming and are directed to the identification and selection of resistant materials for low-sulfur reforming systems, ways to effectively utilize and apply the resistant materials, additives (other than sulfur) for reducing carburization, metal dusting and coking, various process modifications and configurations, and combinations thereof, which effectively address the problems.

More particularly, the discovery has led to the search for, identification of, and selection of resistant materials for low-sulfur reforming systems, preferably the reactor walls, furnace tubes and screens thereof, which were previously unnecessary in conventional reforming systems such as certain alloy and stainless steels, aluminized and chromized materials, and certain ceramic materials. Also, it was discovered that other specific materials, applied as a plating, cladding, paint, etc., can be effectively resistant. These materials include copper, tin, arsenic, antimony, germanium, brass, lead, bismuth, chromium, intermetallic compounds thereof, and alloys thereof, as well as silica and silicon based coatings. In one preferred embodiment of the invention there is provided a novel and resistant tin-containing paint.

Furthermore, the discovery led to the development of certain additives, hereinafter referred to as anticarburizing and anticoking agents, which out of necessity are essentially sulfur free, preferably completely sulfur free, which are novel to reforming. Such additives include organo-tin compounds, organo-antimony compounds, organo-bismuth compounds, organo-arsenic compounds and organo-lead compounds.

Also, the problems associated with low-sulfur reforming has led to the development of certain process modifications and configurations previously unnecessary in conventional reforming. These include certain temperature control techniques, the use of superheated hydrogen between reactors, more frequent catalyst regenerations, the use of staged heaters and tubes, the use of staged temperature zones, the use of superheated raw materials, and the use of larger tube diameters and/or higher tube velocities.

BRIEF DESCRIPTION OF THE DRAWING

As noted above.

FIG. 2 is an illustration of a suitable reforming reactor system for use in the present invention.

DETAILED DESCRIPTION OF THE PREFERRED EMBODIMENTS

Figure 1A:
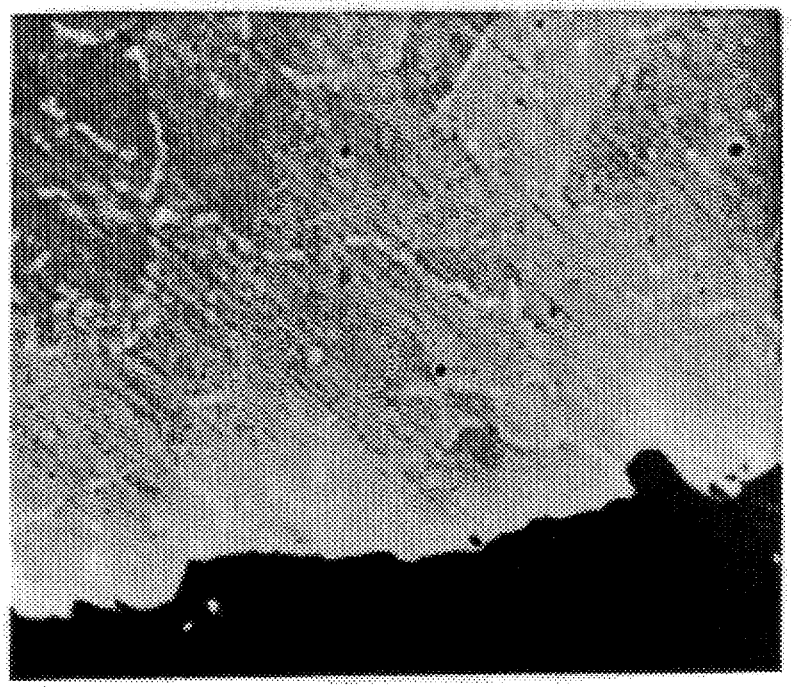
FIG. 1A is a photomicrograph of a portion of the inside (process side) of a mild steel furnace tube from a commercial reformer which had been in use about 19 years; and as also noted above.
Figure 1B:
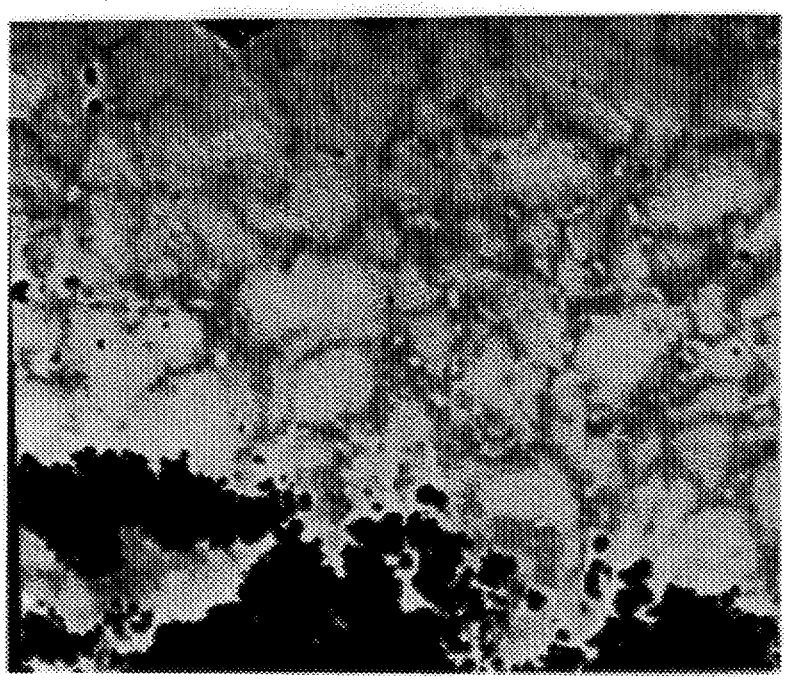
FIG. 1B is a photomicrograph of a portion of a mild steel coupon sample which was placed inside a reactor of a low-sulfur/low-water demonstration plant for only 13 weeks.

The metallurgical terms used herein are to be given their common metallurgical meanings as set forth in THE METALS HANDBOOK of the American Society of Metals. For example, "carbon steels" are those steels having no specified minimum quantity for any alloying element (other than the commonly accepted amounts of manganese, silicon and copper) and containing only an incidental amount of any element other than carbon, silicon, manganese, copper, sulfur and phosphorus. "Mild steels" are those carbon steels with a maximum of about 0.25% carbon. Alloy steels are those steels containing specified quantities of alloying elements (other than carbon and the commonly accepted amounts of manganese, copper, silicon, sulfur and phosphorus) within the limits recognized for constructional alloy steels, added to effect changes in mechanical or physical properties. Alloy steels will contain less than 10% chromium. Stainless steels are any of several steels containing at least 10, preferably 12 to 30%, chromium as the principal alloying element.

Generally, therefore, one focus of the invention is to provide an improved method for reforming hydrocarbons using a reforming catalyst, particularly a large pore zeolite catalyst including an alkali or alkaline earth metal and charged with one or more Group VIII metals which is sulfur sensitive, under conditions of low sulfur. Such a process, of course, must demonstrate better resistance to carburization than conventional low-sulfur reforming techniques.

One solution for the problem addressed by the present invention is to provide a novel reactor system which can include one or more various means for improving resistance to carburization and metal dusting during reforming using a reforming catalyst such as the aforementioned sulfur sensitive large-pore zeolite catalyst under conditions of low sulfur.

By reforming "reactor system" as used herein there is intended at least one reforming reactor and its corresponding furnace means and piping. FIG. 2 illustrates a typical reforming reactor system suitable for practice of the present invention. It can include a plurality of reforming reactors (10), (20) and (30). Each reactor contains a catalyst bed. The system also includes a plurality of furnaces (11), (21) and (31); heat exchanger (12); and separator (13). It will be appreciated that the invention is useful in continuous catalytic reformers utilizing moving beds, as well as fixed bed systems.

Through research associated with the present invention, it was discovered that the aforementioned problems with low-sulfur reforming can be effectively addressed by a selection of an appropriate reactor system material for contact with the hydrocarbons during processing. Typically, reforming reactor systems have been constructed of mild steels, or alloy steels such as typical chromium steels, with insignificant carburization and dusting. For example, under conditions of standard reforming, 2¼ Cr furnace tubes can last twenty years. However, it was found that these steels are unsuitable under low-sulfur reforming conditions. They rapidly become embrittled by carburization within about one year. For example, it was found that 2½ Cr 1 Mo steel carburized and embrittled more than 1 mm/year.

Furthermore, it was found that materials considered under standard metallurgical practice to be resistant to coking and carburization are not necessarily resistant under low-sulfur reforming conditions. For example, nickel-rich alloys such as Incoloy 800 and 825; Inconel 600; Marcel and Haynes 230, are unacceptable as they exhibit excessive coking and dusting.

However, 300 series stainless steels, preferably 304, 316, 321 and 347, are acceptable as materials for at least portions of the reactor system according to the present invention which contact the hydrocarbons. They have been found to have a resistance to carburization greater than mild steels and nickel-rich alloys.

Initially it was believed that aluminized materials such as those sold by Alon Corporation ("Alonized Steels") would not provide adequate protection against carburization in the reforming reactor system and process of the invention. It has since been discovered, however, that the application of thin aluminum or alumina films to metal surfaces of the reforming reactor system, or simply the use of Alonized Steels during construction, can provide surfaces which are sufficiently resistant to carburization and metal dusting under the low-sulfur reforming conditions. However, such materials are relatively expensive, and while resistant to carburization and metal dusting, tend to crack, and show substantial reductions in tensile strengths. Cracks expose the underlying base metal rendering it susceptible to carburization and metal dusting under low sulfur reforming conditions.

While aluminized materials have been used to prevent carburization in ethylene steam cracking processes, such processes are operated at significantly higher temperatures than reforming; temperatures where carburization would be expected. Carburization and metal dusting simply have not been problems in prior reforming processes.

Therefore, another solution to the problems of carburization and metal dusting involves the application of thin aluminum or alumina films on, or the use of aluminized materials as, at least a portion of the metal surfaces in the reactor system. In fact, the metal surfaces particularly susceptible to carburization and metal dusting can be provided in that manner. Such metal surfaces include but are not limited to, the reactor wails, furnace tubes, and furnace liners.

When applying an aluminum or alumina film, it is preferable that the film have a thermal expansivity that is similar to that of the metal surface to which it is applied (such as a mild steel) in order to withstand thermal shocks and repeated temperature cycling which occur during reforming. This prevents cracking or spalling of the film which could expose the underlying metal surface to the carburization inducing hydrocarbon environment.

Additionally, the film should have a thermal conductivity similar to that of, or exceeding, those of metals conventionally used in the construction of reforming reactor systems. Furthermore, the aluminum or alumina film should not degrade in the reforming environment, or in the oxidizing environment associated with catalyst regeneration, nor should it result in the degradation of the hydrocarbons in the reactor system.

Suitable methods for applying aluminum or alumina films to metal surfaces such as mild steels include well known deposition techniques. Preferred processes include powder and vapor diffusion processes such as the "Alonizing" process, which has been commercialized by Alon Processing, Inc., Terrytown, Pa.

Essentially, "Alonizing" is a high temperature diffusion process which alloys aluminum into the surface of a treated metal, such as e.g., a commercial grade mild steel. In this process, the metal (e.g., a mild steel) is positioned in a retort and surrounded with a mixture of blended aluminum powders. The retort is then hermetically sealed and placed in an atmosphere-controlled furnace. At elevated temperatures, the aluminum deeply diffuses into the treated metal resulting in an alloy. After furnace cooling, the substrate is taken out of the retort and excess powder is removed. Straightening, trimming, beveling and other secondary operations can then be performed as required. This process can render the treated ("alonized") metal resistant to carburization and metal dusting under low-sulfur reforming conditions according to the invention.

Thin chromium or chromium oxide films can also be applied to metal surfaces of the reactor system to render the surfaces resistant to carburization and metal dusting under low-sulfur reforming conditions. Like the use of alumina and aluminum films, and aluminized materials, chromium or chromium oxide coated metal surfaces have not been used to address carburization problems under low-sulfur reforming conditions.

The chromium or chromium oxide can also be applied to carburization and metal dusting susceptible metal surfaces such as the reactor walls, furnace liners, and furnace tubes. However, any surface in the system which would show signs of carburization and metal dusting under low-sulfur reforming conditions would benefit from the application of a thin chromium or chromium oxide film.

When applying the chromium or chromium oxide film, it is preferable that the chromium or chromium oxide film have a thermal expansivity similar to that of the metal to which it is applied. Additionally, the chromium or chromium oxide film should be able to withstand thermal shocks and repeated temperature cycling which are common during reforming. This avoids cracking or spalling of the chromium or chromium oxide film which could potentially expose the underlying metal surfaces to carburization inducing environments. Furthermore, the chromium or chromium oxide film should have a thermal conductivity similar to or exceeding those materials conventionally used in reforming reactor systems (in particular mild steels) in order to maintain efficient heat transfer. The chromium or chromium oxide film also should not degrade in the reforming environment or in the oxidizing environment associated with catalyst regeneration, nor should it induce degradation of the hydrocarbons in the reactor system.

Suitable methods for applying chromium or chromium oxide films to surfaces such as e.g., mild steels, include well known deposition techniques. Preferred processes include powder-pack and vapor diffusion processes such as the "chromizing" process, which is commercialized by Alloy Surfaces, Inc., of Wilmington, Del.

The "chromizing" process is essentially a vapor diffusion process for application of chromium to a metal surface (similar to the above described "Alonizing process"). The process involves contacting the metal to be coated with a powder of chromium, followed by a thermal diffusion step. This, in effect, creates an alloy of the chromium with the treated metal and renders the surface extremely resistant to carburization and metal dusting under low-sulfur reforming conditions.

In some areas of the reactor systems, localized temperatures can become excessively high during reforming (e.g., 900°–1250° F.). This is particularly the case in furnace tubes, and in catalyst beds where exothermic demethanation reactions occur within normally occurring coke balls causing localized hot regions. While still preferred to mild steels and nickel-rich alloys, the 300 series stainless steels do exhibit some coking and dusting at around 1000° F. Thus, while useful, the 300 series stainless steels are not the most preferred material for use in the present invention.

Chromium-rich stainless steels such as 446 and 430 are even more resistant to carburization than 300 series stainless steels. However, these steels are not as desirable for heat resisting properties (they tend to become brittle).

Resistant materials which are preferred over the 300 series stainless steels for use in the present invention include copper, tin, arsenic, antimony, germanium, bismuth, chromium and brass, and intermetallic compounds and alloys thereof (e.g., Cu—Sn alloys, Cu—Sb alloys, stannides, antimonides, germanides, bismuthides, etc.). Steels and even nickel-rich alloys containing these metals can also show reduced carburization. In a preferred embodiment, these materials are provided as a continuous plating, cladding, paint (e.g., oxide paints) or other coating to a base construction material. This is particularly advantageous since conventional construction materials such as mild steels can still be used with only the surface contacting the hydrocarbons being treated. Of these, tin is especially preferred as it reacts with the surface to provide a coating having excellent carburization resistance at higher temperatures, and which resists peeling and flaking of the coating. In this regard, relatively thin coatings can be effective. For example, it is believed that a tin containing layer can be as thin as 1/10 micron and still resist carburization.

If steel stress relief techniques are used when assembling a reactor system, the production of iron oxides prior to application of the resistant plating, cladding or coating should be minimized. This can be accomplished by using a nitrogen atmosphere during steel stress relief (e.g., at 1650° F.).

In some instances applying a coating of the aforementioned elements as metals or reducible oxides, will not be particularly preferred. That is, to provide a good coating it is necessary that the material be molten. Unfortunately, some metals such as germanium, and to some extent antimony, have melting points which exceed levels which are practical, or even attainable, with a particular piece of equipment or apparatus. In those instances it is desirable to use compounds of those elements which have lower melting points.

For example, sulfides of antimony and germanium have lower melting points than their respective metals and can be used to produce antimonide and germanide coatings on steels in a $H_2$-rich, or perhaps even a non-reducing, atmosphere. Such sulfides can be used in the form of powders or paints which react to produce antimonide and germanide coatings at significantly lower temperatures than those required for the metals. Tests have shown that antimonide coatings can be applied to 300 series stainless steel and INCOLOY 800 using $Sb_2S_3$ powder at 1030° F. in 20 hours of curing under an atmosphere of 7% $C_3H_8$ in $H_2$. Also, tests have shown that germanide coatings can be applied to INCOLOY 800 using $GeS_2$ powder at 1150° F. under the same conditions.

Where practical, it is preferred that the resistant materials be applied in a paint-like formulation (hereinafter "paint") to a new or existing reactor system. Such a paint can be sprayed, brushed, pigged, etc. on reactor system surfaces such as mild steels or stainless steels, and will have viscosity characteristics sufficient to provide a substantially continuous coating of measurable and substantially controllable thickness.

An example of a useful paint would be one comprising a fusible $CrCl_2$ salt which may or may not be incorporated with solvents and other additives. Other specific formulations include finely ground $CrCl_3$ in 90 wt. gear oil to form a viscous liquid, and finely ground $CrCl_3$ in a petroleum jelly carrier. Such a paint provides a simple low cost method of applying chromium to steel, as it provides clean contact with the steel substrate which permits curing procedures to firmly attach the chromium to the steel. As an example, the paint can be reduced in $H_2$ or another suitable gas at about 1500° F. for 1 hours.

It is most preferred that a paint used according to the invention be a decomposable, reactive, tin-containing paint which reduces to a reactive tin and forms metallic stannides (e.g., iron stannides and nickel/iron stannides) upon heating in a reducing atmosphere (e.g., an atmosphere containing hydrogen and possibly hydrocarbons such as carbon monoxide, etc.).

It is most preferred that the aforementioned tin-containing paint contain at least four components (or their functional equivalents); (i) a hydrogen decomposable tin compound, (ii) a solvent system, (iii) a finely divided tin metal and (iv) tin oxide as a reducible sponge/dispersing/binding agent. The paint should contain finely divided solids to minimize settling, and should not contain non-reactive materials which will prevent reaction of reactive tin with surfaces of the reactor system.

As the hydrogen decomposable tin compound, tin octanoate is particularly useful. Commercial formulations of this compound itself are available and will partially dry to an almost chewing-gum-like layer on a steel surface; a layer which will not crack and/or split. This property is necessary for any coating composition used in this context because it is conceivable that the coated material will be stored for months prior to treatment with hydrogen. Also, if parts are coated prior to assembly they must be resistant to chipping during construction. As noted above, tin octanoate is available commercially. It is reasonably priced, and will decompose smoothly to a reactive tin layer which forms iron stannide in hydrogen at temperatures as low as 600° F.

Tin octanoate should not be used alone in a paint, however. It is not sufficiently viscous. Even when the solvent is evaporated therefrom, the remaining liquid will drip and run on the coated surface. In practice, for example, if such were used to coat a horizontal furnace tube, it would pool at the bottom of the tube.

Component (iv), the tin oxide sponge/dispersing/binding agent, is a porous tin-containing compound which can sponge-up an organo-metallic tin compound, yet still be reduced to active tin in the reducing atmosphere. In addition, tin oxide can be processed through a colloid mill to produce very fine particles which resist rapid settling. The addition of tin oxide will provide a paint which becomes dry to the touch, and resists running.

Unlike typical paint thickeners, component (iv) is selected such that it becomes a reactive part of the coating when reduced. It is not inert like formed silica; a typical paint thickener which would leave an unreactive surface coating after treatment.

Finely divided tin metal, component (iii), is added to insure that metallic tin is available to react with the surface to be coated at as low a temperature as possible, even in a non-reducing atmosphere. The particle size of the tin is preferably one to five microns which allows excellent coverage of the surface to be coated with tin metal. Non-reducing conditions can occur during drying of the paint and welding of pipe joints. The presence of metallic tin ensures that even when part of the coating is not completely reduced, tin metal will be present to react and form the desired stannide layer.

The solvent should be non-toxic, and effective for rendering the paint sprayable and spreadable when desired. It should also evaporate quickly and have compatible solvent properties for the hydrogen decomposable tin compound. Isopropyl alcohol is most preferred, while hexane and pentane can be useful, if necessary. Acetone, however, tends to precipitate organic tin compounds.

In one embodiment, there can be used a tin paint of 20 percent Tin Ten-Gem (stannous octanoate in octanoic acid), stannic oxide, tin metal powder and isopropyl alcohol.

The tin paint can be applied in many ways. For example, furnace tubes of the reactor system can be painted individually or as modules. A reforming reactor system according to the present invention can contain various numbers of furnace tube modules (e.g., about 24 furnace tube modules of suitable width, length and height (e.g., about 10 feet long, about 4 feet wide, and about 40 feet in height). Typically, each module will include two headers of suitable diameter, preferably about 2 feet in diameter, which are connected by about four to ten u-tubes of suitable length (e.g., about 42 feet long). Therefore, the total surface area to be painted in the modules can vary widely; for example, in one embodiment it can be about 16,500 $ft^2$.

Painting modules rather than the tubes individually can be advantageous in at least four respects; (i) painting modules rather than individual tubes should avoid heat destruction of the tin paint as the components of the modules are usually heat treated at extremely elevated temperatures during production; (ii) painting modules will likely be quicker and less expensive than painting tubes individually; (iii) painting modules should be more efficient during production scheduling; and (iv) painting of the modules should enable painting of welds.

However, painting the modules may not enable the tubes to be as completely coated with paint as if the tubes were painted individually. If coating is insufficient, the tubes can be coated individually.

It is preferable that the paint be sprayed into the tubes and headers. Sufficient paint should be applied to provide a continuous coating of the tubes and headers. After a module is sprayed, it should be left to dry for about 24 hours followed by application of a slow stream of heated nitrogen (e.g., about 150° F. for about 24 hours). Thereafter, it is preferable that a second coat of paint be applied and also dried by the procedure described above. After the paint has been applied, the modules should preferably be kept under a slight nitrogen pressure and should not be exposed to temperatures exceeding about 200° F. prior to installation, nor should they be exposed to water except during hydrotesting.

Iron bearing reactive paints are also useful in the present invention. Such an iron bearing reactive paint will preferably contain various tin compounds to which iron has been added in amounts up to one third Fe/Sn by weight.

The addition of iron can, for example, be in the form of $Fe_2O_3$. The addition of iron to a tin containing paint should afford noteworthy advantages; in particular: (i) it should facilitate the reaction of the paint to form iron stannides thereby acting as a flux; (ii) it should dilute the nickel concentration in the stannide layer thereby providing better protection against coking; and (iii) it should result in a paint which affords the anti-coking protection of iron stannides even if the underlying surface does not react well.

According to a preferred embodiment of the invention, there is formed a protective layer anchored to a steel substrate through an intermediate carbide-rich (relative to the underlying steel) bonding phase. As noted above, effective protective layers can be derived from a variety of metals such as tin, copper, arsenic, antimony, bismuth, chromium, germanium, gallium, indium, selenium, tellurium, and lead. Here the metals are more preferably tin, germanium, antimony, arsenic, selenium, chromium and tellurium. Of these, fin, germanium and antimony are more preferred, with tin being the most preferred. Gallium, lead, bismuth, brass, indium and copper are less preferred, with brass and copper being the least preferred. Lead, bismuth and indium do not react with iron, although they can be used on nickel-rich materials such as INCONEL 600 (75% Ni/16% chromium/7% Fe).

Multiple coatings can be applied. For example, a tin coating can be applied, and cured, followed by copper plating. Although, it has been found that copper is effective for preventing carburization and metal dusting, it does not generally adhere well to steel. Peeling and flaking of the copper is observed. However, if the steel surface is first coated with tin, then the copper plate will adhere well to the coating, and provide additional protection to the metal surface. In essence, the resulting stannide layer functions as a glue which adheres the copper plate to the underlying steel.

One of the aforementioned metals is first applied to a portion (or portions) of a low-sulfur reforming reactor system as a plating, cladding or other coating to a thickness effective to provide a complete coating. Then the plating, cladding or coating is treated in a manner effective to form a protective layer which is anchored to the steel substrate through a carbide-rich protective layer. Such a plating, cladding, or other coating can be resistant to abrasion, peeling or flaking for a period of 1 year, preferably 2 years, and more preferably 3 years such that the reactor system will maintain its carburization resistant properties without reapplication.

A preferred embodiment of the invention uses a reactor system including a stainless steel portion, which comprises providing the stainless steel portion with a stannide protective layer of sufficient thickness to isolate the stainless steel portion from hydrocarbons, which protective layer is anchored to the steel substrate through an intermediate carbide-rich, nickel-depleted stainless steel bonding layer. More particularly, the stannide layer is nickel-enriched and comprises carbide inclusions, while the intermediate carbide-rich, nickel-depleted bonding layer comprises stannide inclusions. More preferably the carbide inclusions are continuous extensions or projections of the bonding layer as they extend, substantially without interruption, from the intermediate carbide-rich, nickel-depleted bonding layer into the stannide phase, and the stannide inclusions are likewise continuous extending from the stannide layer into the intermediate carbide-rich, nickel-depleted bonding layer. The interface between the intermediate carbide-rich, nickel-depleted bonding layer and the nickel-enriched stannide layer is irregular, but is otherwise substantially without interruption.

Forming a protective layer according to the invention will depend on temperature treatment after application of the aforementioned metals, and the nature of the base metal. Taking the application of tin as an example, Ni3Sn, Ni3Sn2, and Ni3Sn4 can all be expected in nickel-rich systems, and Fe3Sn, Fe3Sn2, and FeSn in iron-rich systems. Under temperature exposures of from about 925° to 1200° F., one can expect an X3Sn2 solid solution on stainless steels. On nickel-free steels there is observed Fe3Sn2 overlain by FeSn. Below 925° F. one can expect FeSn2 but not Fe3Sn2. On stainless steels there is observed FeSn overlain by FeSn2 overlain by Ni3Sn4. At high temperatures, e.g., 1600° F., there can be found (Ni,Fe)3Sn and (Ni,Fe)3Sn2 on stainless steels, but no steel-tin alloy, while on nickel-free steels there is found a diffusion layer of iron-tin alloy overlain by the phases Fe3Sn and Fe3Sn2.

The extent to which the aforementioned phases, layers and inclusions develop are a function of the reducing conditions and temperature at which the initial plating, cladding or other coating is treated, and the mount of time at which exposure is maintained. The metallic coatings and, in particular, the paints, are preferably treated under reducing conditions with hydrogen. Curing is preferably done in the absence of hydrocarbons. When tin paints are applied at the above-described thicknesses, initial reduction conditions will result in tin migrating to cover small regions (e.g., welds) which were not painted. This will completely coat the base metal. This curing results, for example, in a strong protective layer preferably between 0.5 and 10 mils thick, and more preferably between 1 and 4 mils thick comprising intermetallic compounds. In the case of tin, stannide layers such as iron and nickel stannides are formed. Microscopic analysis can readily determine the thickness of this layer. For ease of measurement of paint and coating thickness, coupons can be prepared which correspond to the painted reactor surface. These can be treated under identical conditions to the reactor system treatment. The coupons can be used to determine paint and coating thickness.

For tin-containing paints, it is preferable to initially cure the paint at temperatures between 500° and 1100° F., preferably between 900° and 1000° F. As an example of a suitable treatment, the system including painted portions can be pressurized with $N_2$, followed by the addition of $H_2$ to a concentration greater than or equal to 50% $H_2$. The reactor inlet temperature can be raised to 800° F. at a rate of 50°–100° F./hr. Thereafter the temperature can be raised to a level of 950°–975° F. at a rate of 50° F./hr, and held within that range for about 48 hours. Curing can also be achieved in pure $H_2$ at 1000° F. to 1200° F. for 2–24 hours.

In the case of a stannide protective layer applied by plating tin on an INCOLOY 800 substrate (a nickel-rich steel), exposure to low curing temperatures, i.e., three weeks at 650° F. was observed to produce discrete iron and nickel stannide phases; with an unacceptably reactive nickel phase on the exterior. However, exposure at higher temperatures, i.e., one week at 650° F. followed by two weeks at 1000° F., was observed to provide acceptable stannide phases where the stannide was reconstituted to comparable nickel and iron abundance in each stannide phase. Exposure to even higher temperatures, i.e., one week at 650° F. followed by one week at 1000° F. and one week at 1200° F., showed a reconstitution of the stannide layer and carbide-rich under layer, to produce potentially reactive nickel-rich stannides, particularly on the surface of the protective layer. In this regard, it is believed that inclusion of iron, for example, in a paint formulation can be an effective counter-measure when curing at high temperatures.

Chromium paints are preferably reduced at higher temperatures than tin paints in order to produce metallic chromium-containing coatings. Useful reduction temperatures are above 1200° F., preferably at about 1400° F. or higher. As an example, a chromium-containing paint can be reduced in $H_2$ or another suitable gas at about 1500° F. for 1 hours.

A test was conducted where unpainted steel samples where placed in reforming reactors that had been treated with a carburization resistant tin-based paint like those described above prior to reduction of the paint. The unpainted samples were nevertheless found to have uniform coatings of protective stannide after reduction. Thus, the aforementioned tin-containing paints, or other carburization resistant platings, claddings or coatings, can also be touched-up according to the invention. For example, a touch-up protective tin-based, antimony-based, germanium-based, etc., coating can be formed by injecting a fine powder of the metal, metal oxide, or other reactive compound of the metal, in a reducing gas stream containing $H_2$ and possibly hydrocarbons. Because of the migration characteristics of these metals, they will allow a fine mist of reactive liquid metal to react with exposed steel surfaces. In using the touch-up technique, catalyst beds should be removed or otherwise protected. It follows that the above-described technique could be used to provide original protective coatings, as well.

Coking and carburization protection of tin on steel can also be applied, re-applied and/or touched-up by using tin halides at elevated temperatures. Tin metal reacts with, for example, HCl to form volatile tin chlorides which disperse over steel and react to form protective iron/nickel stannides. Tin volatiles can be controlled by varying temperature and halide composition.

The technology associated with the invention can also be used for retrofitting previously carburized systems for use in low-sulfur, and low-sulfur and low-water processes. For example, one of the aforementioned protective layers can be formed on a previously carburized surface by a suitable deposition technique such as chemical vapor deposition, or, if physically possible, by applying a paint of one or more of the protective materials described herein.

In retrofitting a previously carburized system, the protective layer should have a thermal expansivity close to that of the base metal, and should be able to withstand thermal shock and repeated temperature cycling, so the layer will not crack or spall and expose the base metal to the environment. In addition, the layer should have a thermal conductivity near or above those of commonly employed metals to maintain efficient heat transfer. The layer should not degrade in the reforming environment nor in the oxidizing environment associated with common catalyst regeneration (coke burn-off), nor cause degradation of the hydrocarbons themselves.

Before retrofitting by creating the protective layer, coke should be removed from the surface of the base metal as it may interfere with the reaction between the protective layer and the base metal. A number of cleaning techniques are possible including (i) oxidizing the metal surface, (ii) oxidizing the metal surface and chemically cleaning, (iii) oxidizing the metal surface, and chemically cleaning followed by passivation, and (iv) oxidizing the metal surface and physically cleaning. Technique (i) is useful to remove residual coke and would be acceptable if the oxide layer was thin enough to allow a protective layer such as a stannide layer to form properly. The other techniques, therefore, are more preferred as they should remove the oxide layer to prevent interference with the formation of an effective protective layer. Of course, combinations of the aforementioned cleaning techniques in a particular plant, or for a particular system, can be used. Ultimately a number of factors unique to the particular plant or system, such as reactor geometry, will dictate the choice.

Another potentially useful method for applying protective layers of carburization resistant materials is chemical vapor deposition ("CVD"). CVD techniques can be used in new or existing plants. CVD would be particularly useful in existing plants where other techniques prove to be difficult or impossible.

A preferred CVD technique involves vaporizing an organometallic compound containing one or more of the protective materials described herein in a hydrogen or hydrogen/inert gas mixture. Examples of such organometallic compounds include copper naphthenate, tetramethyl tin, tetrabutyl tin, triphenyl arsine, tributylantimony, bismuth neodecanoate, and chromium octoate. The saturate gas should be heated so the organometallic compound will decompose on the base material. This approach would work particularly well in a temperature controlled furnace. The optimum conditions for the decomposition reaction will depend on the particular organometallic compound used.

Yet another means for preventing carburization, coking, and metal dusting in the low-sulfur reactor system comprises the application of a metal coating or cladding to chromium rich steels contained in the reactor system. These metal coatings or claddings may be comprised of tin, antimony, germanium, bismuth or arsenic. Tin is especially preferred. These coatings or claddings may be applied by methods including electroplating, vapor depositing, and soaking of the chromium rich steel in a molten metal bath.

It has been found that in low-sulfur reforming reactor systems where carburization, coking, and metal dusting are particularly problematic that the coating of the chromium-rich, nickel-containing steels with a layer of tin in effect creates a double protective layer. There results an inner chromium rich layer which is resistant to carburization, coking, and metal dusting and an outer tin layer which is also resistant to carburization, coking and metal dusting. This occurs because when the tin coated chromium rich steel is exposed to typical reforming temperatures, such as about 1200° F., it reacts with the steel to form iron nickel stannides. Thereby, the nickel is preferentially leached from the surface of the steel leaving behind a layer of chromium rich steel. In some instances, it may be desirable to remove the iron nickel stannide layer from the stainless steel to expose the chromium rich steel layer.

For example, it was found that when a tin cladding was applied to a 304 grade stainless steel and heated at about 1200° F. there resulted a chromium rich steel layer containing about 17% chromium and substantially no nickel, comparable to 430 grade stainless steel.

When applying the tin metal coating or cladding to the chromium rich steel, it may be desirable to vary the thickness of the metal coating or cladding to achieve the desired resistance against carburization, coking, and metal dusting. This can be done by, e.g., adjusting the amount of time the chromium rich steel is soaked in a molten tin bath. This will also affect the thickness of the resulting chromium rich steel layer. It may also be desirable to vary the operating temperature, or to vary the composition of the chromium rich steel which is coated in order to control the chromium concentration in the chromium rich steel layer produced.

It has additionally been found that tin-coated steels can be further protected from carburization, metal dusting, and coking by a post-treatment process which involves application of a thin oxide coating, preferably a chromium oxide, such as $Cr_2O_3$. This coating will be thin, as thin as a few μm. Application of such a chromium oxide coating will protect aluminum as well as tin coated steels, such as Alonized steels, under low-sulfur reforming conditions.

The chromium oxide layer can be applied by various methods including: application of a chromate or dichromate paint followed by a reduction process; vapor treatment with an organo-chromium compound; or application of a chromium metal plating followed by oxidation of the resulting chromium plated steel.

Examination of tin-electroplated steels which have been subjected to low-sulfur reforming conditions for a substantial period of time has shown that when a chromium oxide layer is produced on the surface of the stannide layer or under the stannide layer, the chromium oxide layer does not cause deterioration of the stannide layer, but appears to render the steel further resistant to carburization, coking and metal dusting. Accordingly, application of a chromium oxide layer to either tin or aluminum coated steels will result in steels which are further resistant to carburization and coking under the low-sulfur reforming conditions. This post-treatment process has particular applications for treating tin or aluminum coated steels which, after prolonged exposure to low-sulfur reforming conditions, are in need of repair.

It has further been found that aluminized, e.g., "Alonized" steels which are resistant to carburization under the present reforming conditions of low sulfur can be rendered further resistant by post-treatment of the aluminum coated steel with a coating of tin. This results in a steel which is more carburization resistant since there are cumulative effects of carburization resistance obtained from both the aluminum coating and the tin coating. This post-treatment affords an additional benefit in that it will mend any defects or cracks in the aluminum, e.g., Alonized, coating. Also, such a post-treatment should result in a lower cost since a thinner aluminum coating can be applied to the steel surface which is to be post-treated with the tin coating. Additionally, this post-treatment will protect the underlying steel layer exposed by bending of aluminized steels, which can introduce cracks in the aluminum layer, and expose the steel to carburization induced under reforming conditions. Also, this post-treatment process can prevent coke formation on the treated steel surfaces and also prevent coke formation that occurs on the bottom of cracks which appear on steels which have been aluminized, but not additionally coated with tin.

Samples of Alonized Steels painted on one side with tin, were found to show a deposit of black coke only on the untreated side under low-sulfur reforming conditions. The coke that forms on an aluminized surface is a benign coke resulting from cracking on acidic alumina sites. It is incapable of inducing additional coke deposition. Accordingly, a post-treatment application of a fin coating to aluminized steels can provide further minimization of the problems of carburization, coking, and metal dusting, in reactor systems operating under reforming conditions according to the invention.

While not wishing to be bound by theory, it is believed that the suitability of various materials for the present invention can be selected and classified according to their responses to carburizing atmospheres. For example, iron, cobalt, and nickel form relatively unstable carbides which will subsequently carburize, coke and dust. Elements such as chromium, niobium, vanadium, tungsten, molybdenum, tantalum and zirconium, will form stable carbides which are more resistant to carburization coking and dusting. Elements such as tin, antimony, germanium, and bismuth do not form carbides or coke. And, these compounds can form stable compounds with many metals such as iron, nickel and copper under reforming conditions. Stannides, antimonides, germanides, and bismuthides, and compounds of lead, mercury, arsenic, germanium, indium, tellurium, selenium, thallium, sulfur and oxygen are also resistant. A final category of materials include elements such as silver, copper, gold, platinum and refractory oxides such as silica and alumina. These materials are resistant and do not form carbides, or react with other metals in a carburizing environment under reforming conditions.

As discussed above, the selection of appropriate metals which are resistant to carburization and metal dusting, and their use as coating materials for metal surfaces in the reactor system is one means for preventing the carburization and metal dusting problem. However, carburization and metal dusting can be prevalent in a wide variety of metals; and carburization resistant metals can be more costly or exotic than conventional materials (e.g., mild steels) used in the construction of reforming reactor systems. Accordingly, it may be desirable in the reactor system of the invention to use ceramic materials which do not form carbides at typical reforming conditions, and thus are not susceptible to carburization, for at least a portion of the metal surfaces in the reactor system. For example, at least a portion of the furnace tubes, or furnace liners or both may be constructed of ceramic materials.

In choosing the ceramic materials for use in the present invention, it is preferable that the ceramic material have thermal conductivities about that or exceeding those of materials conventionally used in the construction of reforming reactor systems. Additionally, the ceramic materials should have sufficient structural strengths at the temperatures which occur within the reforming reactor system. Further, the ceramic materials should be able to withstand thermal shocks and repeated temperature cycling which occur during operation of the reactor system. When the ceramic materials are used for constructing the furnace liners, the ceramic materials should have thermal expansivities about that of the metal outer surfaces with which the liner is in intimate contact. This avoids undue stress at the juncture during temperature cycling that occurs during start-up and shut-down. Additionally, the ceramic surface should not be susceptible to degradation in the hydrocarbon environment or in the oxidizing environment which occurs during catalyst regeneration. The selected ceramic material also should not promote the degradation of the hydrocarbons in the reactor system.

Suitable ceramic materials include, but are not restricted to, materials such as silicon carbides, silicon oxides, silicon nitrides and aluminum nitrides. Of these, silicon carbides and silicon nitrides are particularly preferred as they appear capable of providing complete protection for the reactor system under low-sulfur reforming conditions.

At least a portion of the metal surfaces in the reactor system can also be coated with a silicon or silica film. In particular, the metal surfaces which can be coated include, but are not limited to the reactor walls, furnace tubes, and furnace liners. However, any metal surface in the reactor system, which shows signs of carburization and metal dusting under low-sulfur reforming conditions would benefit from the application of a thin silicon or silica film.

Conventional methods can be used for applying silicon or silica films to coat metal surfaces. Silica or silicon can be applied by electroplating and chemical vapor deposition of an alkoxysilane in a steam carrier gas. It is preferable that the silicon or silica film have a thermal expansivity about that of the metal surface which it coats. Additionally, the silicon or silica film should be able to withstand thermal shocks and repeated temperature cycling that occur during reforming. This avoids cracking or spalling of the silicon or silica film, and potential exposure of the underlying metal surface to the carburization inducing hydrocarbon environment. Also, the silica or silicon film should have a thermal conductivity approximate to or exceeding that of metals conventionally used in reforming reactor systems so as to maintain efficient heat transfer. The silicon or silica film also should not degrade in the reforming environment or in the oxidizing environment associated with catalyst regeneration; nor should it cause degradation of the hydrocarbons themselves.

Because different areas of the reactor system of the invention (e.g., different areas in a furnace) can be exposed to a wide range of temperatures, the material selection can be staged, such that those materials providing better carburization resistances are used in those areas of the system experiencing the highest temperatures.

With regard to materials selection, it was discovered that oxidized Group VIII metal surfaces such as iron, nickel and cobalt are more active in terms of coking and carburization than their unoxidized counterparts. For example, it was found that an air roasted sample of 347 stainless steel was significantly more active than an unoxidized sample of the same steel. This is believed to be due to a re-reduction of oxidized steels which produces very fine-grained iron and/or nickel metals. Such metals are especially active for carburization and coking. Thus, it is desirable to avoid these materials as much as possible during oxidative regeneration processes, such as those typically used in catalytic reforming. However, it has been found that an air roasted 300 series stainless steel coated with tin can provide similar resistances to coking and carburization as unroasted samples of the same tin coated 300 series stainless steel.

Furthermore, it will be appreciated that oxidation will be a problem in systems where sulfur sensitivity of the catalyst is not of concern, and sulfur is used to passivate the metal surfaces. If sulfur levels in such systems ever become insufficient, any metal sulfides which have formed on metal surfaces would, after oxidation and reduction, be reduced to fine-grained metal. This metal would be highly reactive for coking and carburization. Potentially, this can cause a catastrophic failure of the metallurgy, or a major coking event.

Other techniques can also be used to address the problem discovered according to the present invention. They can be used in conjunction with an appropriate material selection for the reactor system, or they can be used alone. Preferred from among the additional techniques is the addition of non-sulfur, anti-carburizing and anti-coking agent(s) during the reforming process. These agents can be added continuously during processing and function to interact with those surfaces of the reactor system which contact the hydrocarbons, or they may be applied as a pretreatment to the reactor system.

While not wishing to bound by theory it is believed that these agents interact with the surfaces of the reactor system by decomposition and surface attack to form iron and/or nickel intermetallic compounds, such as stannides, antimonides, bismuthides, plumbides, arsenides, etc. Such intermetallic compounds are resistant to carburization, coking and dusting and can protect the underlying metallurgy.

The intermetallic compounds are alto believed to be more stable than the metal sulfides which were formed in systems where $H_2S$ was used to passivate the metal. These compounds are not reduced by hydrogen as are metal sulfides. As a result, they are less likely to leave the system than metal sulfides. Therefore, the continuous addition of a carburization inhibitor with the feed can be minimized.

Preferred non-sulfur anti-carburizing and anti-coking agents include organo-metallic compounds such as organo-tin compounds, organo-antimony compounds, organo-germanium compounds, organo-bismuth compounds, organo-arsenic compounds, and organo-lead compounds. Suitable organo-lead compounds include tetraethyl and tetramethyl lead. Organo-tin compounds such as tetrabutyl tin and trimethyl tin hydride are especially preferred.

Additional specific organo-metallic compounds include bismuth neodecanoate, chromium octoate, copper naphthenate, manganese carboxylate, palladium neodecanoate, silver neodecanoate, tetrabutylgermanium, tributylantimony, triphenylantimony, triphenylarsine, and zirconium octoate.

How and where these agents are added to the reactor system is not critical, and will primarily depend on particular process design characteristics. For example, they can be added continuously or discontinuously with the feed.

However, adding the agents to the feed is not preferred as they would tend to accumulate in the initial portions of the reactor system. This may not provide adequate protection in the other areas of the system.

It is preferred that the agents be provided as a coating prior to construction, prior to start-up, or in-situ (i.e., in an existing system). If added in-situ, it should be done right after catalyst regeneration. Very thin coatings can be applied. For example, it is believed that when using organo-tin compounds, iron stannide coatings as thin as 0.1 micron can be effective.

A preferred method of coating the agents on an existing or new reactor surface, or a new or existing furnace tube is to decompose an organometallic compound in a hydrogen atmosphere at temperatures of about 900° F. For organo-tin compounds, for example, this produces reactive metallic tin on the tube surface. At these temperatures the tin will further react with the surface metal to passivate it.

Optimum coating temperatures will depend on the particular organometallic compound, or the mixtures of compounds if alloys are desired. Typically, an excess of the organometallic coating agent can be pulsed into the tubes at a high hydrogen flow rate so as to carry the coating agent throughout the system in a mist. The flow rate can then be reduced to permit the coating metal mist to coat and react with the furnace tube or reactor surface. Alternatively, the compound can be introduced as a vapor which decomposes and reacts with the hot walls of the tube or reactor in a reducing atmosphere.

As discussed above, reforming reactor systems susceptible to carburization, metal dusting and coking can be treated by application of a decomposable coating containing a decomposable organometallic tin compound to those areas of the reactor system most susceptible to carburization. Such an approach works particularly well in a temperature controlled furnace.

However, such control is not always present. Them are "hot spots" which develop in the reactor system, particularly in the furnace tubes, where the organometallic compound can decompose and form deposits. Therefore, another aspect of the invention is a process which avoids such deposition in reforming reactor systems where temperatures are not closely controlled and exhibit areas of high temperature hot spots.

Such a process involves preheating the entire reactor system to a temperature of from 750 to 1150, preferably 900 to 1100, and most preferably about 1050° F., with a hot stream of hydrogen gas. After preheating, a colder gas stream at a temperature of 400 to 800, preferably 500 to 700, and most preferably about 550° F., containing a vaporized organometallic tin compound and hydrogen gas is introduced into the preheated reactor system. This gas mixture is introduced upstream and can provide a decomposition "wave" which travels throughout the entire reactor system.

Essentially this process works because the hot hydrogen gas produces a uniformly heated surface which will decompose the colder organometallic gas as it travels as a wave throughout the reactor system. The colder gas containing the organometallic tin compound will decompose on the hot surface and coat the surface. The organometallic tin vapor will continue to move as a wave to treat the hotter surfaces downstream in the reactor system. Thereby, the entire reactor system can have a uniform coating of the organometallic tin compound. It may also be desirable to conduct several of these hot-cold temperature cycles to ensure that the entire reactor system has been uniformly coated with the organometallic tin compound.

In operation of the reforming reactor system according to the present invention, naphtha will be reformed to form aromatics. The naphtha feed is a light hydrocarbon, preferably boiling in the range of about 70° F. to 450° F., more preferably about 100° to 350° F. The naphtha feed will contain aliphatic or paraffinic hydrocarbons. These aliphatics are convened, at least in part, to aromatics in the reforming reaction zone.

In the "low-sulfur" system of the invention, the feed will preferably contain less than 100 ppb sulfur, more preferably, less than 50 ppb sulfur, and even more preferably, less than 25 ppb sulfur; e.g., less than 5 ppb sulfur. If necessary, a sulfur sorber unit can be employed to remove small excesses of sulfur.

Preferred reforming process conditions include a temperature between 700° and 1050° F., more preferably between 850° and 1025° F.; and a pressure between 0 and 400 psig, more preferably between 15 and 150 psig; a recycle hydrogen rate sufficient to yield a hydrogen to hydrocarbon mole ratio for the feed to the reforming reaction zone between 0.1 and 20, more preferably between 0.5 and 10; and a liquid hourly space velocity for the hydrocarbon feed over the reforming catalyst of between 0.1 and 10, more preferably between 0.5 and 5.

To achieve the suitable reformer temperatures, it is often necessary to heat the furnace tubes to high temperatures. These temperatures can often range from 600° to 1800° F., usually from 850° and 1250° F., and more often from 900 °and 1200° F.

As noted above, the problems of carburization, coking and metal dusting in low-sulfur systems have been found to associated with excessively high, localized process temperatures of the reactor system, and are particularly acute in the furnace tubes of the system where particularly high temperatures are characteristic. In conventional reforming techniques where high levels of sulfur are present, furnace tube skin temperatures of up to 1175° F. at end of run are typical. Yet, excessive carburization, coking and metal dusting was not observed. In low-sulfur systems, however, it has been discovered that excessive and rapid carburization, coking and metal dusting occurred with CrMo steels at temperatures above 950° F., and stainless steels at temperatures above 1025° F.

Accordingly, another aspect of the invention is to lower the temperatures of the metal surfaces inside the furnace tubes, transfer-lines and/or reactors of the reforming system below the aforementioned levels. For example, temperatures can be monitored using thermocouples attached at various locations in the reactor system. In the case of furnace tubes, thermocouples can be attached to the outer walls thereof, preferably at the hottest point of the furnace (usually near the furnace outlet. When necessary, adjustments in process operation can be made to maintain the temperatures at desired levels.

There are other techniques for reducing exposure of system surfaces to undesirably high temperatures as well. For example, heat transfer areas can be used with resistant (and usually more costly) tubing in the final stage where temperatures are usually the highest.

In addition, superheated hydrogen can be added between reactors of the reforming system. Also, a larger catalyst charge can be used. And, the catalyst can be regenerated more frequently. In the case of catalyst regeneration, it is best accomplished using a moving bed process where the catalyst is withdrawn from the final bed, regenerated, and charged to the first bed.

Carburization and metal dusting can also be minimized in the low-sulfur reforming reactor system of the invention by using certain other novel equipment configurations and process conditions. For example, the reactor system can be constructed with staged heaters and/or tubes. In other words, the heaters or tubes which are subjected to the most extreme temperature conditions in the reactor system can be constructed of materials more resistant to carburization than materials conventionally used in the construction of reforming reactor systems; materials such as those described above. Heaters or tubes which are not subjected to extreme temperatures can continue to be constructed of conventional materials.

By using such a staged design in the reactor system, it is possible to reduce the overall cost of the system (since carburization resistant materials are generally more expensive than conventional materials) while still providing a reactor system which is sufficiently resistant to carburization and metal dusting under low-sulfur reforming conditions. Additionally, this should facilitate the retrofitting of existing reforming reactor systems to render them carburization and metal dusting resistant under low-sulfur operating conditions; since a smaller portion of the reactor system would need replacement or modification with a staged design.

The reactor system can also be operated using at least two temperature zones; at least one of higher and one of lower temperature. This approach is based on the observation that metal dusting has a temperature maximum and minimum, above and below which dusting is minimized. Therefore, by "higher" temperatures, it is meant that the temperatures are higher than those conventionally used in reforming reactor systems and higher than the temperature maximum for dusting. By "lower" temperatures it is meant that the temperature is at or about the temperatures which reforming processes are conventionally conducted, and falls below that in which dusting becomes a problem.

Operation of portions of the reactor system in different temperature zones should reduce metal dusting as less of the reactor system is at a temperature conducive for metal dusting. Also, other advantages of such a design include improved heat transfer efficiencies and the ability to reduce equipment size because of the operation of portions of the system at higher temperatures. However, operating portions of the reactor system at levels below and above that conducive for metal dusting would only minimize, not completely avoid, the temperature range at which metal dusting occurs. This is unavoidable because of temperature fluctuations which will occur during day to day operation of the reforming reactor system; particularly fluctuations during shut-down and start-up of the system, temperature fluctuations during cycling, and temperature fluctuations which will occur as the process fluids are heated in the reactor system.

Another approach to minimizing metal dusting relates to providing heat to the system using superheated raw materials (such as e.g., hydrogen), thereby minimizing the need to heat the hydrocarbons through furnace walls.

Yet another process design approach involves providing a pre-existing low-sulfur reforming reactor system with larger tube diameters and/or higher tube velocities. Using larger tube diameters and/or higher tube velocities will minimize the exposure of the heating surfaces in the reactor system to the hydrocarbons.

As noted above, catalytic reforming is well known in the petroleum industry and involves the treatment of naphtha fractions to improve octane rating by the production of aromatics. The more important hydrocarbon reactions which occur during the reforming operation include the dehydrogenation of cyclohexanes to aromatics, dehydroisomerization of alkylcyclopentanes to aromatics, and dehydrocyclization of acyclic hydrocarbons to aromatics. In addition, a number of other reactions also occur, including the dealkylation of alkylbenzenes, isomerization of paraffins, and hydrocracking reactions which produce light gaseous hydrocarbons, e.g., methane, ethane, propane and butane, which hydrocracking reactions should be minimized during reforming as they decrease the yield of gasoline boning products and hydrogen. Thus, "reforming" as used herein refers to the treatment of a hydrocarbon feed through the use of one or more aromatics producing reactions in order to provide an aromatics enriched product (i.e., a product whose aromatics content is greater than in the feed).

The present invention is directed to catalytic reforming of various hydrocarbon feedstocks under conditions of low sulfur. While catalytic reforming typically refers to the conversion of naphthas, other feedstocks can be treated as well to provide an aromatics enriched product. Therefore, while the conversion of naphthas is a preferred embodiment, the present invention can be useful for the conversion or aromatization of a variety of feedstocks such as paraffin hydrocarbons, olefin hydrocarbons, acetylene hydrocarbons, cyclic paraffin hydrocarbons, cyclic olefin hydrocarbons, and mixtures thereof, and particularly saturated hydrocarbons.

Examples of paraffin hydrocarbons are those having 6 to 10 carbons such as n-hexane, methylpentane, n-heptane, methylhexane, dimethylpentane and n-octane. Examples of acetylene hydrocarbons are those having 6 to 10 carbon atoms such as hexyne, heptyne and octyne. Examples of acyclic paraffin hydrocarbons are those having 6 to 10 carbon atoms such as methylcyclopentane, cyclohexane, methylcyclohexane and dimethylcyclohexane. Typical examples of cyclic olefin hydrocarbons are those having 6 to 10 carbon atoms such as methylcyclopentene, cyclohexene, methylcyclohexene, and dimethylcyclohexene.

The present invention will also be useful for reforming under low-sulfur conditions using a variety of different reforming catalysts. Such catalyst include, but are not limited to Noble Group VIII metals on refractory inorganic oxides such as platinum on alumina, Pt/SN on alumina and Pt/Re on alumina; Noble Group VIII metals on a zeolite such as Pt, Pt/SN and Pt/Re on zeolites such as L-zeolites, ZSM-5, silicalite and beta; and Noble Group VIII metals on alkali- and alkaline-earth exchanged L-zeolites.

A preferred embodiment of the invention involves the use of a large-pore zeolite catalyst including an alkali or alkaline earth metal and charged with one or more Group VIII metals. Most preferred is the embodiment where such a catalyst is used in reforming a naphtha feed.

The term "large-pore zeolite" is indicative generally of a zeolite having an effective pore diameter of 6 to 15 Angstroms. Preferable large pore crystalline zeolites which are useful in the present invention include the type L zeolite, zeolite X, zeolite Y and faujasite. These have apparent pore sizes on the order to 7 to 9 Angstroms. Most preferably the zeolite is a type L zeolite.

The composition of type L zeolite expressed in terms of mole ratios of oxides, may be represented by the following formula:

$$(0.9\text{–}1.3)M_{2/n}O:AL_2O_3(5.2\text{–}6.9)SIO_2:yH_2O$$

In the above formula M represents a cation, n represents the valence of M, and y may be any value from 0 to about 9. Zeolite L, its X-ray diffraction pattern, its properties, and method for its preparation are described in detail in, for example, U.S. Pat. No. 3,216,789, the contents of which is hereby incorporated by reference. The actual formula may vary without changing the crystalline structure. For example, the mole ratio of silicon to aluminum (Si/Al) may vary from 1.0 to 3.5.

The chemical formula for zeolite Y expressed in terms of mole ratios of oxides may be written as:

$$(0.7\text{–}1.1)Na_2O:Al_2O_3:xSiO_2:yH_2O$$

In the above formula, x is a value greater than 3 and up to about 6. y may be a value up to about 9. Zeolite Y has a characteristic X-ray powder diffraction pattern which may be employed with the above formula for identification. Zeolite Y is described in more detail in U.S. Pat. No. 3,130,007 the contents of which is hereby incorporated by reference.

Zeolite X is a synthetic crystalline zeolitic molecular sieve which may be represented by the formula:

$$(0.7\text{–}1.1)M_{2/n}O:Al_2O_3:(2.0\text{–}3.0)SiO_2:yH_2O$$

In the above formula, M represents a metal, particularly alkali and alkaline earth metals, n is the valence of M, and y may have any value up to about 8 depending on the identity of M and the degree of hydration of the crystalline zeolite. Zeolite X, its X-ray diffraction pattern, its properties, and method for its preparation are described in detail in U.S.

Pat. No. 2,882,244 the contents of which is hereby incorporated by reference.

An alkali or alkaline earth metal is preferably present in the large-pore zeolite. That alkaline earth metal may be either barium, strontium or calcium, preferably barium. The alkaline earth metal can be incorporated into the zeolite by synthesis, impregnation or ion exchange. Barium is preferred to the other alkaline earths because it results in a somewhat less acidic catalyst. Strong acidity is undesirable in the catalyst because it promotes cracking, resulting in lower selectivity.

In another embodiment, at least past of the alkali metal can be exchanged with barium using known techniques for ion exchange of zeolites. This involves contacting the zeolite with a solution containing excess $Ba^{++}$ ions. In this embodiment the barium should preferably constitute from 0.1% to 35% by weight of the zeolite.

The large-pore zeolitic catalysts used in the invention are charged with one or more Group VIII metals, e.g., nickel, ruthenium, rhodium, palladium, iridium or platinum. The preferred Group VIII metals are iridium and particularly platinum. These are more selective with regard to dehydrocyclization and are also more stable under the dehydrocyclization reaction conditions than other Group VIII metals. If used, the preferred weight percentage of platinum in the catalyst is between 0.1% and 5%.

Group VIII metals are introduced into large-pore zeolites by synthesis, impregnation or exchange in an aqueous solution of appropriate salt. When it is desired to introduce two Group VIII metals into the zeolite, the operation may be carried out simultaneously or sequentially.

To obtain a more complete understanding of the present invention, the following examples illustrating certain aspects of the invention are set forth. It should be understood, however, that the invention is not limited in any way to the specific details set forth therein.

EXAMPLE 1

Tests were run to demonstrate the effect of sulfur and water on carburization in reforming reactors.

In these tests, eight inch long, ¼ inch outside diameter copper tubes were used as a reactor to study the carburization and embrittlement of 347 stainless steel wires. Three of these stainless steel wires having a diameter of 0.035 inches were inserted into the tube, while a four inch section of the tube was maintained at a uniform temperature of 1250° F. by a furnace. The pressure of the system was maintained at 50 psig. Hexane was introduced into the reactor at a rate of 25 microliters/min. (1.5 ml/hr) with a hydrogen rate of about 25 cc/min. (ratio of $H_2$ to HC being 5:1). Methane in the product effluent was measured to determine the existence of exothermic methane reactions.

A control run was made using essentially pure hexane containing less than 0.2 ppm sulfur. The tube was found to be completely filled with carbon after only three hours. This not only stopped the flow of the hydrogen and hexane feeds, the growth of carbon actually split the tube and produced a bulge in the reactor. Methane in the product effluent was approaching 60–80 wt % before plugging.

Another run was conducted using essentially the same conditions except that 10 ppm sulfur was added. The run continued for 50 hours before it was shut down to examine the wires. No increase in methane was noted during the run. It remained steady at about 16 wt % due to thermal cracking. No coke plugs were found and no carburization of the steel wires was observed.

Another identical run was made except that only 1 ppm sulfur was added (10 times lower than the previous run). This run exhibited little methane formation or plugging after 48 hours. An examination of the steel wires showed a small amount of surface carbon, but no ribbons of carbon.

Another run was conducted except that 1000 ppm water (0.1%) was added to the hexane as methanol. No sulfur was added. The run lasted for 16 hours and no plugs occurred in the reactor. However, upon splitting the tube it was discovered that about 50 percent of the tube was filled with carbon. But the carbon buildup was not nearly as severe as with the control run.

EXAMPLE 2

Tests were conducted to determine suitable materials for use in low-sulfur reforming reactor systems; materials which would exhibit better resistance to carburization than the mild steels conventionally used in low-sulfur reforming techniques.

In these tests there was used an apparatus including a Lindberg alumina tube furnace with temperatures controlled to within one degree with a thermocouple placed on the exterior of the tube in the heated zone. The furnace tube had an internal diameter of ⅝ inches. Several runs were conducted at an applied temperature of 1200° F. using a thermocouple suspended within the hot zone (≈2 inches) of the tube. The internal thermocouple constantly measured temperatures from 0° to 10° F. lower than the external thermocouple.

Samples of mild steels (C steel and 2¼ Cr) and samples of 300 series stainless steels were tested at 1100° F., 1150° F. and 1200° F. for twenty-four hours, and 1100° F. for ninety hours, under conditions which simulate the exposure of the materials under conditions of low-sulfur reforming. The samples of various materials were placed in an open quartz boat within the hot zone of the furnace tube. The boats were one inch long and ½ inch wide and fit well within the two-inch hot zone of the tube. The boats were attached to silica glass rods for each placement and removal. No internal thermocouple was used when the boats were placed inside the tube.

Prior to start up the tube was flushed with nitrogen for a few minutes. A carburizing gas of a commercially bottled mixture of 7% propane in hydrogen was bubbled through a liter flask of toluene at room temperature in order entrain about 1% toluene in the feed gas mix. Gas flows of 25 to 30 cc/min., and atmospheric pressure, were maintained in the apparatus. The samples were brought to operating temperatures at a rate of 144° F./min.

After exposing the materials to the carburizing gas for the desired period at the desired temperature, the apparatus was quenched with an air stream applied to the exterior of the tube. When the apparatus was sufficiently cool, the hydrocarbon gas was swept out with nitrogen and the boat was removed for inspection and analysis.

Prior to start up the test materials were cut to a size and shape suitable for ready-visual identification. After any pretreatment, such as cleaning or roasting, the samples were weighed. Most samples were less than 300 mg. Typically, each run was conducted with three to five samples in a boat. A sample of 347 stainless steel was present with each run as an internal standard.

After completion of each run the condition of the boat and each material was carefully noted. Typically the boat was photographed. Then, each material was weighed to determine changes while talking care to keep any coke deposits with the appropriate substrate material. The samples were then mounted in an epoxy resin, ground and polished in preparation for petrographic and scanning electron microscopy analysis to determine the coking, metal dusting and carburization responses of each material.

By necessity, the residence time of the carburizing gas used in these tests were considerably higher than in typical commercial operation. Thus, it is believed that the experimental conditions may have been more severe than commercial conditions. Some of the materials which failed in these tests may actually be commercially reliable. Nevertheless, the test provides a reliable indication of the relative resistances of the materials to coking, carburization and metal dusting.

The results are set forth in the Table below.

TABLE*

| | Wt. % C Gain | Dusting | Composition | |
|---|---|---|---|---|
| 1200° F.; 24 hours | | | | |
| C Steel | 86 | Severe | | |
| 2 ¼ Cr | | 61 | Severe | |
| 304 | | little | No | 18 Cr 10 Ni |
| 347 | | little | No | 18 Cr 10 Ni |
| 1150° F.; 24 hours | | | | |
| C Steel | | 63 | Severe | |
| 2 ¼ Cr | | 80 | Severe | |
| 304 | | 1 | No | |
| 347 | | 1 | No | |
| 1100° F.; 24 hours | | | | |
| C Steel Trace | | Trace, localized | | |
| 2 ¼ Cr | | 0 | No | |
| 304 | | 0 | No | |
| 347 | | 0 | No | |
| 1100° F.; 90 hours | | | | |
| C Steel | | 52 | Severe | |
| 2 ¼ Cr | | 62 | Severe | |
| 304 | | 5 | No | |
| 347 | | 1 | No | |

*15% $C_7H_8$ + 50% $C_3H_8$ + $H_2$ (by weight)

Of course, the above results are qualitative and depend on surface morphology, i.e., microscopic roughness of the metals. The carbon weight gain is indicative of surface coking which is autocatalytic.

EXAMPLE 3

The same techniques used above were used again to screen a wide assortment of materials at a temperature of 1200° F. for 16 hours. The results are set forth below. Each group represents a side-by-side comparison in a single boat under identical conditions.

TABLE (1)

| | Wt. % C Gain | Dusting | Composition | |
|---|---|---|---|---|
| Group I | | | | |
| Inconel 600 | | 57 | Severe | 15 Cr 75 Ni |
| 347 oxid. (2) | | 21 | Moderate | |
| 347 Fresh | | 4 | No | 18 Cr 10 Ni |

TABLE (1)-continued

| | Wt. % C Gain | Dusting | Composition | |
|---|---|---|---|---|
| Group II | | | | |
| Inconel 600 | | 40 | Severe | 15 Cr 75 Ni |
| 310 | | 8 | Mild | 25 Cr 20 Ni |
| Incoloy 800 | | 5 | Moderate | 21 Cr 32 Ni |
| 347 | | 1 | Trace | |
| Group III | | | | |
| Incoloy 825 | | <1 | Moderate | |
| Haynes 230 | | 2 | Mild | 22 Cr 64 Ni |
| Alonized 347 | | 3 | Trace | |
| 347 | | <1 | Trace | |
| Group IV | | | | |
| Ni (Pure) | | 656 | Severe | 100 Ni |
| Cu (Pure) | | 0 | No | 100 Cu |
| Sn (Fused) | | 0 | No | 100 Sn |
| Tin Can | | 0 | No | Sn + C Steel |

(1) 15% $C_7H_8$ + 50% $C_3H_8$ + $H_2$ (By Wt.)
(2) Roasted in air 2 hours at 1000° C. to produce a thin oxide crust.

EXAMPLE 4

Additional materials were tested, again using the techniques described in Example 2 (unless stated otherwise).

Samples of 446 stainless steel and 347 stainless steel were placed in a sample boat and tested simultaneously in the carburization apparatus at 1100° F. for a total of two weeks. The 446 stainless steel had a thin coating of coke, but no other alteration was detected. The 347 stainless steel, on the other hand, had massive localized coke deposits, and pits more than 4 mils deep from which coke and metal dust had erupted.

Samples were tested of a carbon steel screen electroplated with tin, silver, copper and chromium. the samples had coatings of approximately 0.5 mil. After 16-hour carburization screening tests at 1200° F., no coke had formed on the tin-plated and chromium-plated screens. Coke formed on the silver-plated and copper-plated screens, but only where the platings had peeled. Unplated carbon steel screens run simultaneously with the plated screens, exhibited severe coking carburization, and metal dusting.

Samples were tested of a 304 stainless steel screen; each sample being electroplated with one of tin, silver, copper and chromium. The samples had coatings with thicknesses of approximately 0.5 mil. After 16-hour carburization screening tests at 1200° F., no coke had formed on any of the plated screens, except locally on the copper-plated screen where the plating had blistered and peeled. Thin coke coatings were observed on unplated samples of 304 stainless steel run simultaneously with the plated screens.

Samples were tested of a 304 stainless steel screen; each sample being electroplated with one of tin and chromium. These samples were tested along with a sample of 446 stainless steel in a carburization test at 1100° F. The samples were exposed or five weeks. Each week the samples were cooled to room temperature for observation and photographic documentation. They were then re-heated to 1100° F. The tin plated screen was free of coke; the chromium-plated screen was also free of coke, except locally where the chrome plate had peeled; and the piece of 446 stainless steel was uniformly coated with coke.

Samples of uncoated Inconel 600 (75% Ni) and tin-coated (electroplated) Inconel 600 (75% Ni) were tested at 1200° F.

for 16 hours. The tin-plated sample coked and dusted, but not to the extent of the uncoated sample.

EXAMPLE 5

The following experiments were conducted to study the exothermic methanization reaction occurring during the formation and burning of cokeballs during reforming under conditions of low-sulfur. In addition tin, as an additive to reduce methane formation was studied.

In low-sulfur reforming reactor systems, coke deposits containing molten particles of iron have been found. This formation of molten iron during reforming at temperatures between 900° and 1200° F. is believed to be due to very exothermic reactions which occur during reforming. It is believed that the only way to generate such temperatures is through the formation of methane which is very exothermic. The high temperatures are particularly surprising since reforming is generally endothermic in nature and actually tends to cool the reactor system. The high temperatures may be generated inside the well insulated cokeballs by diffusion of hydrogen into the interior catalytic iron dust sites where they catalyze methane formation from coke and hydrogen.

In this experiment steel wool was used to study methane formation in a micro pilot plant. A ¼ inch stainless steel tube was packed with 0.14 grams of steel wool and placed into a furnace at 1175° F. Hexane and hydrogen were passed over the iron and the exit stream was analyzed for feed and products. The steel wool was pretreated in hydrogen for twenty hours before introduction of the hexane. Then hexane was introduced into the reactor at a rate of 25 microliters/min. with a hydrogen rate of about 25 cc/min.

Initially, methane formation was low, but continued to increase as the run progressed; finally reaching 4.5%. Then, 0.1 cc of tetrabutyl tin dissolved in 2 cc of hexane was injected into the purified feed stream ahead of the iron. The methane formation decreased to about 1% and continued to remain at 1% for the next three hours. The data is summarized in the Table below.

TABLE

| HOURS | CH4 | ETHANE | PROPANE | HEXANE |
|---|---|---|---|---|
| 19.2 | 0.0 | 0.5 | 0.3 | 98.6 |
| 20.7 | 1.06 | 2.08 | 1.74 | 93.4 |
| 21.2 | 2.62 | 4.55 | 3.92 | 85.3 |
| 21.5 | 3.43 | 4.23 | 3.83 | 84.6 |
| 21.9 | 4.45 | 4.50 | 4.32 | 82.0 |
| | | Tetrabutyl Tin Added | | |
| 22.6 | 1.16 | 3.81 | 4.12 | 86.2 |
| 23.0 | 1.16 | 3.96 | 4.24 | 85.9 |
| 23.3 | 1.0 | 4.56 | 3.77 | 87.5 |
| 24.3 | 0.97 | 3.60 | 3.76 | 87.6 |
| 25.3 | 1.0 | 4.47 | 3.57 | 88.0 |

From the results above it can be seen that the addition of tin to the steel wool stops the acceleration of methane formation, and lowers it to acceptable levels in the product.

EXAMPLE 6

Additional tests were conducted using tetrabutyl tin pre-coated steel wool. In particular, as in Example 5, three injections of 0.1 cc of tetrabutyl tin dissolved in 2 cc of hexane were injected into a ¼ inch stainless steel tube containing 0.15 grams of steel wool. The solution was carried over the steel wool in a hydrogen stream of 900° F.

The hydrocarbon feed was then introduced at 1175° F. at a hydrocarbon rate of 25 microliters/min with a hydrogen rate of about 25 cc/min. The exit gas was analyzed for methane and remained below 1% for 24 hours. The reactor was then shut down, and the reactor tube was split open and examined. Very little carburization had occurred on the steel wool.

In contrast, a control was run without tetrabutyl tin pre-treatment. It was run for one day under the same conditions described above. After 24 hours, no hydrogen or feed could be detected at the tube exit. The inlet pressure had risen to 300 lbs. from the original 50 lbs. When the reactor tube was split open and examined, it was found that coke had completely plugged the tube.

Thus, it can be seen that organo-tin compounds can prevent carburization of steel wool under reforming conditions.

EXAMPLE 7

Another run like the control run of Example 1 was conducted to investigate the effect of carburization conditions on vapor tin coated stainless steel wires in a gold plated reactor tube. The only other difference from the control run was that a higher hydrogen rate of 100 ml/min was used.

The run continued for eight hours with no plugging or excessive methane formation. When the tube was split and analyzed, no plugs or carbon ribbons were observed. Only one black streak of carbon appeared on one wire. This was probably due to an improper coating.

This experiment shows that tin can protect stainless steel from carburization in a manner similar to sulfur. Unlike sulfur, however, it does not have to be continuously injected into the feed. Sulfur must be continuously injected into the feed to maintain the partial pressure of hydrogen sulfide in the system at a sufficient level to maintain a sulfide surface on the steel. Any removal of sulfur from the feedstock will lead to a start of carburization after sulfur is stripped from the reactor system. This usually occurs within 10 hours after cessation of sulfur.

While the invention has been described above in terms of preferred embodiments, it is to be understood that variations and modifications may be used as will be appreciated by those skilled in the art. For example, portions of steel in the reactor system can be coated with niobium, zirconium, silica ceramics, tungsten, or chromium (chromizing), although these techniques could be excessively difficult to do or use, or prohibitively expensive. Or, the use of heat exchangers to heat hydrocarbons to reaction temperature could be minimized. The heat could be provided by super-heated hydrogen. Or, the exposure of heating surfaces to hydrocarbons can be reduced by using larger tube diameters and higher tube velocities. Essentially, therefore, there are many variations and modifications to the above preferred embodiments which will be readily evident to those skilled in the art, and which are to be considered within the scope of the invention as defined by the following claims.

What is claimed is:

1. A method for the catalytic reforming of paraffinic hydrocarbons using platinum L-zeolite catalyst to produce aromatics comprising:

(i) preparing a low sulfur paraffinic hydrocarbon containing feed by processing which includes reducing the sulfur content of a paraffin containing stream to less than about 50 ppb sulfur to achieve an acceptable stability and activity level for the platinum L-zeolite catalyst;

(ii) providing a commercial scale reforming reactor system of improved carburization resistance, said system comprising at least one furnace with a plurality of furnace tubes to contact said low sulfur hydrocarbon feed and heat said feed to catalytic reforming temperatures and a plurality of reforming reactors having walls in contact with the heated low sulfur hydrocarbon feed, at least one of said reactors containing said platinum L-zeolite reforming catalyst, at least some of said furnace tubes having a carburization resistance greater than that of mild steel and greater than that of 2¼ Cr 1 Mo steel; and (iii) passing said low sulfur hydrocarbon containing feed through said reactor system to contact paraffinic hydrocarbons with said platinum L-zeolite reforming catalyst to produce aromatics.

2. A method for the catalytic reforming of paraffinic hydrocarbons using a platinum L-zeolite catalyst to produce aromatics comprising:

(i) preparing a low sulfur paraffinic hydrocarbon containing feed by processing which includes reducing the sulfur content of a paraffin containing stream to less than about 50 ppb sulfur to achieve an acceptable stability and activity level for the platinum L-zeolite catalyst;

(ii) providing a commercial scale reforming reactor system of improved carburization resistance, said system comprising at least one furnace with a plurality of furnace tubes to contact said low sulfur hydrocarbon feed and heat said feed to catalytic reforming temperatures and a plurality of reforming reactors having walls in contact with the heated low sulfur hydrocarbon feed, at least one of said reactors containing said platinum L-zeolite reforming catalyst, at least some of said furnace tubes and walls having a carburization resistance greater than that of mild steel and greater than that of 2¼ Cr 1 Mo steel; and (iii) passing said low sulfur hydrocarbon containing feed through said reactor system to contact paraffinic hydrocarbons with said platinum L-zeolite reforming catalyst to produce aromatics.

3. A method for the catalytic reforming of paraffinic hydrocarbons according to claim 2, wherein at least some of said furnace tubes and walls have a carburization resistance greater than that of 300 series steel.

4. A method according to claim 1, wherein at least some of said furnace tubes have a decomposable, reactive, tin-containing paint applied to their surfaces contacting said low sulfur hydrocarbon feed, which paint reduces upon heating in a reducing environment to a reactive tin which forms a metallic stannide with the tubes to provide said carburization resistance.

5. The method according to claim 4 wherein said paint comprises (i) a hydrogen decomposable tin compound, (ii) a solvent system, (iii) a finely divided tin metal, and (iv) a tin oxide.

6. The method according to claim 5 wherein said hydrogen decomposable tin compound is tin octanoate.

7. A method according to claim 5 wherein said finely divided tin metal has a particle size of about 1 to 5 microns.

8. A method according to claim 5 wherein said solvent system contains at least one member selected from isopropyl alcohol, hexane and pentane.

9. A method according to claim 5 wherein said solvent system contains isopropyl alcohol.

10. A method according to claim 5 wherein said paint is sprayable.

11. A method according to claim 4 wherein said paint comprises a hydrogen decomposable tin compound and a tin oxide.

12. A method according to claim 4 wherein said paint contains no non-reactive material which will prevent reactive tin from reacting with the portion of the reforming reactor system to which the paint is applied.

13. A method according to claim 4 wherein said paint is sprayable.

14. A method according to claim 4 wherein said paint comprises finely divided tin metal.

15. A method according to claim 14 wherein said finely divided tin metal has a particle size of about 1 to 5 microns.

16. A method according to claim 4 wherein said paint further comprises one or more iron compounds.

17. A method according to claim 16 wherein said paint further comprises one or more iron compounds and wherein the ratio of Fe/Sn is up to 1:3 by weight.

18. A method according to claim 16 wherein said iron compound is $Fe_2O_3$.

* * * * *